United States Patent [19]

Moore et al.

[11] Patent Number: 4,898,642

[45] **Date of Patent: * Feb. 6, 1990**

[54] TWISTED, CHEMICALLY STIFFENED CELLULOSIC FIBERS AND ABSORBENT STRUCTURES MADE THEREFROM

[75] Inventors: Danny R. Moore, Germantown; James W. Owens; Howard L. Schoggen, both of Memphis, all of Tenn.

[73] Assignee: The Procter & Gamble Cellulose Company, Memphis, Tenn.

[ * ] Notice: The portion of the term of this patent subsequent to Apr. 18, 2006 has been disclaimed.

[21] Appl. No.: 304,925

[22] Filed: Feb. 1, 1989

Related U.S. Application Data

[63] Continuation of Ser. No. 21,953, Mar. 5, 1987, abandoned, which is a continuation-in-part of Ser. No. 879,671, Jun. 27, 1986, abandoned.

[51] Int. Cl.[4] ..... D21H 5/12; D06M 1/00

[52] U.S. Cl. ..... 162/157.6; 8/116.4; 162/158; 162/182; 604/375; 536/56

[58] Field of Search ..... 8/116.1, 116.4; 162/157.6, 158, 182, 100, 9, 10; 604/375; 536/56

[56] References Cited

U.S. PATENT DOCUMENTS

| | | | |
|---|---|---|---|
| 2,971,815 | 2/1961 | Bullock et al. | 8/116.2 |
| 3,046,079 | 7/1962 | Reeves et al. | 8/116.4 |
| 3,224,926 | 12/1965 | Benardin | 162/146 |
| 3,241,553 | 3/1966 | Steiger | 128/156 |
| 3,434,918 | 3/1969 | Bernardin | 162/111 |
| 3,440,135 | 4/1969 | Chung | 162/157 |
| 3,455,778 | 7/1969 | Bernardin | 162/113 |
| 3,756,913 | 9/1973 | Wodka | 162/183 |
| 3,819,470 | 6/1974 | Shaw et al. | 162/157 |
| 3,932,209 | 1/1976 | Chatterjee | 162/157 |
| 4,035,147 | 7/1977 | Sangenis et al. | 8/116.4 |
| 4,204,054 | 5/1980 | Lesas et al. | 536/56 |
| 4,204,055 | 5/1980 | Lesas et al. | 536/56 |
| 4,689,118 | 8/1987 | Makoui et al. | 162/100 |

FOREIGN PATENT DOCUMENTS

| | | | |
|---|---|---|---|
| 993618 | 7/1976 | Canada | 19/2 |
| 0122042 | 10/1984 | European Pat. Off. . | |

OTHER PUBLICATIONS

Anonymous Disclosure, "Process of Making Resin Treated Cellulosic Fibers", Research Disclosures, Aug. 1981, #20837.

R. E. Mark et al., "Twisting Energy of Hollocellulose Fibers", J. Polymer Sci.: Part C, No. 36, pp. 177–195, (1971), J. Wiley & Sons, Inc.

*Primary Examiner*—Prince E. Willis
*Assistant Examiner*—John F McNally
*Attorney, Agent, or Firm*—Leonard W. Lewis; Bart S. Hersko; Fredrick H. Braun

[57] ABSTRACT

Individualized, stiffened, twisted cellulosic fibers and absorbent structures made from such fibers. The fibers have an average dry fiber twist count of at least about 4.5 twist nodes per millimeter, an average wet fiber twist count of at least about 0.5 twist nodes per millimeter less than the dry fiber twist count, and a water retention value of between about 28% and about 50%. Preferably the fibers have an average wet fiber twist count of at least about 3.0 twist nodes per millimeter and an isopropyl alcohol retention value of less than about 30%.

28 Claims, 2 Drawing Sheets

IPA TRANSPORT INDEX
4.0
3.5
3.0
2.5
2.0
20
22
24
26
0.05
0.10
0.15
0.20
0.25
0.30
ABSORBENT STRUCTURE DENSITY
(g/cc, DRY FIBER BASIS)

WATER TRANSPORT INDEX
11
10
9
8
7
6
5
4
3
2
1
38
36
34
32
30
0.05
0.10
0.15
0.20
0.25
0.30
ABSORBENT STRUCTURE DENSITY
(g/cc, DRY FIBER BASIS)

TWISTED, CHEMICALLY STIFFENED CELLULOSIC FIBERS AND ABSORBENT STRUCTURES MADE THEREFROM

This is a continuation of application Ser. No. 021,953, filed on Mar. 5, 1987, now abandoned, which is a continuation-in-part of application Ser. No. 879,671 filed on June 27, 1986, now abandoned.

FIELD OF INVENTION

This invention is concerned with cellulosic fibers having high fluid absorption properties and absorbent structures made from such cellulosic fibers. More specifically, this invention is concerned with absorbent cellulosic fibers and structures made from such fibers wherein the cellulosic fibers which are in an individualized, stiffened, twisted, and curled condition.

BACKGROUND OF THE INVENTION

Fibers stiffened in substantially individualized form and various methods for making such fibers have been described in the art. Individualized, stiffened fibers are generally regarded as being useful in absorbent product applications. Two primary categories of such fibers are individualized, crosslinked fibers and individualized, resin-treated fibers. The term "individualized, crosslinked fibers", refers to cellulosic fibers that have primarily intrafiber chemical crosslink bonds. That is, the crosslink bonds are primarily between cellulose molecules of a single fiber, rather than between cellulose molecules of separate fibers. Generally, monomeric crosslinking agents are contemplated for crosslinking of individualized fibers, although some resins that have been used to stiffen fibers are known to also have functionalities which may be useful for forming crosslink bonds. For the purpose of this discussion, fibers stiffened with such resins will be included in the term "resin-treated fibers." In general, three categories of processes have been reported for making individualized, crosslinked fibers. These processes, described below, are herein referred to as (1) dry crosslinking processes, (2) aqueous solution crosslinking processes, and (3) substantially non-aqueous solution crosslinking processes. The fibers themselves and absorbent structures containing individualized, crosslinked fibers generally exhibit an improvement in at least one significant absorbency property relative to conventional, uncrosslinked fibers. Often, this improvement in absorbency is reported in terms of absorbent capacity. Additionally, absorbent structures made from individualized crosslinked fibers generally exhibit increased wet resilience and increased dry resilience relative to absorbent structures made from uncrosslinked fibers. The term "resilience" shall hereinafter refer to the ability of pads made from cellulosic fibers to return toward an expanded original state upon release of a compressional force. Dry resilience specifically refers to the ability of an absorbent structure to expand upon release of compressional force applied while the fibers are in a substantially dry condition. Wet resilience specifically refers to the ability of an absorbent structure to expand upon release of compressional force applied while the fibers are in a moistened condition. For the purposes of this invention and consistency of disclosure, wet resilience shall be observed and reported for an absorbent structure moistened to saturation.

Processes for making individualized, crosslinked fibers with dry crosslinking technology are described in U.S. Pat. No. 3,224,926 issued to L. J. Bernardin on Dec. 21, 1965 and U.S. Pat. No. 3,440,135, issued to R. Chung on Apr. 22, 1969. Individualized, crosslinked fibers are produced by impregnating swollen fibers in an aqueous solution with crosslinking agent, dewatering and defiberizing the fibers by mechanical action, and drying the fibers at elevated temperature to effect crosslinking while the fibers are in a substantially individual state. The fibers are inherently crosslinked in an unswollen, state as a result of being dehydrated prior to crosslinking. Processes as exemplified in U.S. Pat. No. 3,224,926 and wherein crosslinking is caused to occur while the fibers are in an unswollen, collapsed state, are referred to as processes for making "dry crosslinked" fibers. Dry crosslinked fibers have been characterized by low water retention values (WRV).

Processes for producing aqueous solution crosslinked fibers are disclosed, for example, in U.S. Pat. No. 3,241,553, issued to F. H. Steiger on Mar. 22, 1966. Individualized, crosslinked fibers are produced by crosslinking the fibers in an aqueous solution containing a crosslinking agent and a catalyst. Fibers produced in this manner are hereinafter referred to as "aqueous solution crosslinked" fibers. Due to the swelling effect of water on ellulosic fibers, aqueous solution crosslinked fibers are crosslinked while in a swollen state. Relative to dry crosslinked fibers, aqueous solution crosslinked fibers as disclosed in U.S. Pat. No. 3,241,553 have greater flexibility and less stiffness, and are characterized by higher water retention value (WRV). Absorbent structures made from aqueous solution crosslinked fibers exhibit lower wet and dry resilience than pads made from dry crosslinked fibers.

In U.S. Pat. No. 4,035,147, issued to S. Sangenis, G. Guiroy and J. Quere on July 12, 1977, a method is disclosed for producing individualized, crosslinked fibers by contacting dehydrated, nonswollen fibers with crosslinking agent and catalyst in a substantially nonaqueous solution which contains an insufficient amount of water to cause the fibers to swell. Crosslinking occurs while the fibers are in this substantially nonaqueous solution. This type of process shall hereinafter be referred to as a nonaqueous solution crosslinking process; and the fibers thereby produced, shall be referred to as nonaqueous solution crosslinked fibers. The nonaqueous solution crosslinked fibers disclosed in U.S. Pat. No. 4,035,147 are alleged to not swell even upon extended contact with solutions known to those skilled in the art as swelling reagents. Like the dry crosslinked fibers discussed above, such fibers would be highly stiffened by crosslink bonds, and absorbent structures made therefrom would exhibit relatively high wet and dry resilience.

Crosslinked fibers as described above are believed to have application to lower density absorbent products such as diapers and also higher density absorbent products such as sanitary napkins. However, such fibers have not attained commercial significance. One reason for the lack of commercial success may be that dry crosslinked fibers in general and many nonaqueous solution crosslinked fibers have been characterized in the literature by excessive stiffness and dry resiliency. Such fibers are difficult to form into densified sheets for transport and subsequently refluff without fiber damage. Furthermore, when compressed in a dry state, pads made from these fibers exhibit a low responsiveness to wetting. Once they are subjected to sufficient pressure to provide a dry pad of stable, high density, the pads have reduced susceptibility to expand toward their precompression volume upon wetting. It is believed that this lack of responsiveness to wetting is due to excessive stiffness of the fibers and fiber breakage upon exposure to high levels of compression.

Commercial viability of nonaqueous solution crosslinked fibers in particular is severely hampered because of high capital costs of implementing such processes and because of the additional expense of solvents necessary for the extraction and reaction mediums.

Aqueous solution crosslinked fibers, while useful for certain higher density absorbent pad applications such as tampons wherein densities ordinarily are about 0.40 g/cc, are excessively flexible when in a wet state and therefore result in absorbent structures which have low wet resilience. Furthermore, upon wetting, aqueous solution crosslinked fibers become too flexible to structurally support the pad at lower fiber densities. The wetted pad therefore has limited ability to retain its volume or to expand upon wetting when in a compressed state and final absorbent capacity is reduced.

It is an object of this invention to provide commercially viable individualized, stiffened fibers and absorbent structures made from such fibers wherein the absorbent structures made from the stiffened fibers have high absorbency, wicking ability, wet resilience and responsiveness to wetting.

It is further an object of this invention to provide fibers and absorbent structures having the attributes described in the preceding paragraph in combination with sufficiently low dry resilience such that the absorbent structures can be easily compressed in a dry, volume-stable form which expands upon wetting.

Recently, thinness of absorbent products especially in the diaper and catamenial industries has become a highly desirable product attribute. Good absorbent performance is still an important aspect of such products. To date, good absorbency has been achieved largely through use of polymeric gel forming materials. The effectiveness of polymeric gel forming materials may be limited by an absorbent structure's ability to transport fluid to the polymeric gelling material or to portions of the absorbent structure due to swelling of the polymeric gelling material. Therefore, it is another object of this invention to provide absorbent structures, and cellulose fibers useful for making such absorbent structures, which have small caliper relative to absorbent structures of conventional, unstiffened fibers but which have superior wicking ability and absorbent capacity.

Upon reading the present disclosure, other objectives and benefits provided by the present invention may presently or later become apparent to those skilled in the art.

SUMMARY OF THE INVENTION

It has been found that the objects identified above may be met by the cellulosic fibers of the present invention. The fibers are individualized, curled, stiffened, highly twisted cellulosic fibers stiffened by chemical treatment and have an average dry fiber twist count of at least about 4.5 twist nodes per millimeter, a water retention value of between about 28% and about 50% and an average wet fiber twist count of at least about 0.5 twist nodes per millimeter less than the dry fiber twist count. Preferably the fibers have an average wet fiber twist count of at least about 3.0 twist nodes per millimeter. Also preferably, the fibers have an isopropyl alcohol retention value of less than about 30%.

Fibers as defined above combine high levels of expansion upon wetting and wet resilience in absorbent structures. Furthermore, unexpected improvements in wicking ability and resistance to delamination upon folding while in a wet condition have been obtained for absorbent structures made from these fibers described above. Significantly, these fibers can be made by dry crosslinking processes which avoid high processing material and capital equipment costs incurred with nonaqueous solution curing processes.

DETAILED DESCRIPTION OF THE INVENTION AND PREFERRED EMBODIMENTS

Figure 1:
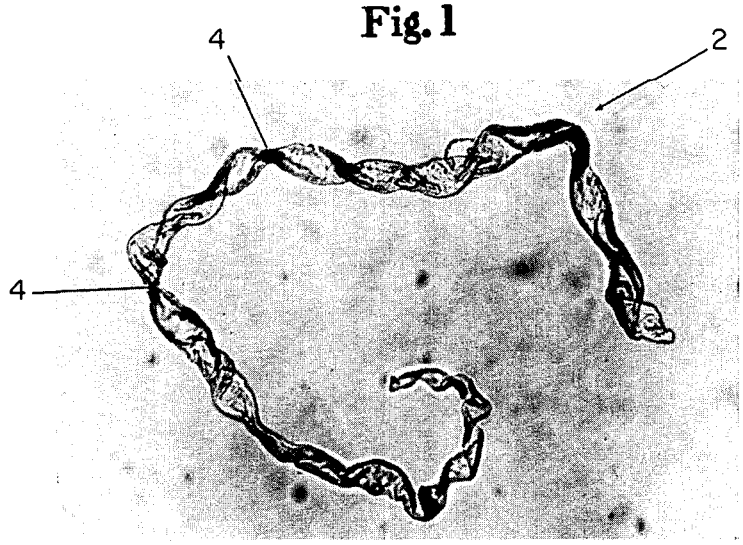
FIG. 1 is a photomicrograph of an individualized, twisted, stiffened, dry springwood fiber taken at a magnification level of 200X with transmitted light. The photomicrograph was prepared with the fiber in an immersion oil which does not induce swelling or untwisting of the fiber.

The fibers of the present invention are chemically stiffened while in a curled, highly twisted, dehydrated and substantially completely unswollen state. Without limiting the scope of the invention, it is believed that these physical characteristics of the fibers contribute to and are responsible for the superior absorbency, volumetric responsiveness to wetting of compressed structures made from the fibers, and wicking ability of structures made from the fibers. In addition to these absorbent characteristics, structures made from the highly twisted fibers of the present invention have unexpectedly displayed improved resistance to delamination upon folding while in a wet state. While prior known fibers which have been stiffened by chemical means may match the present fibers in certain of these performance areas, none of them match the present fibers in all three of these performance areas. Additionally, many of the best of the prior known fibers have been made by processes involving a fiber stiffening step conducted in a liquid, nonaqueous solution which is more expensive in terms of raw materials cost as well as capital cost than processes wherein the stiffening step is conducted in a dry state. Additionally, prior known fibers made according to these nonaqueous solution stiffening processes have not provided fibers with wicking ability as high as that provided by the fibers of the present invention. Fibers made by prior known dry chemical stiffening processes have either provided structures with volumetric responsiveness to wetting which is inferior to those of the present fibers or have been extremely difficult to compress to a stable density greater than the absorbent structure's saturation density.

The fibers of the present invention are believed to provide absorbent structures that have superior volumetric responsiveness to wetting and wicking ability because the fibers are curled and highly twisted with a limited but relatively high ability to untwist upon wetting; and further, because they combine a substantially unswollen dry fiber geometry along with a limited ability to swell upon wetting.

The ability of an absorbent structure made from cellulosic fibers to expand upon wetting is dependent upon the expansionary forces created or unleashed within or by the fiber matrix upon wetting and the degree of fiber stiffness which is related to the structure's structural integrity in the volumetrically expanded condition. In other terms, the absorbent structure must be able to expand and have sufficient structural integrity to support the weight of the fibers and absorbed fluid when in the expanded condition.

Expansionary forces are created or unleashed within the fiber matrix of the absorbent structures of the present invention when, due to wetting, the fibers untwist to a lower twist count level. This untwisting along with the presence of a curled fiber geometry results in a translational movement of the fiber out of the fiber's previous static resting position. As this occurs to a mass of fibers within a fiber matrix, having a sufficiently high dry density, the fibers tend to exert pressure against one another to create a fiber matrix expansionary force capable of causing the matrix to expand even as a load is applied opposing such expansion.

It has been observed that fibers which completely untwist upon wetting provide absorbent structures with low structural integrity. It has been observed that fibers which completely untwist upon wetting retain insufficient fiber stiffness to provide absorbent structures with high wet resilience. It is desirable that the fibers of the present invention untwist but retain sufficient stiffness for high wet resilience.

Wicking ability of absorbent structures has been found to be affected by the fiber diameter and interfiber capillary size of the fiber matrix. Those skilled in the art will recognize that there will be some optimal range of capillary cross-section at which the balance of the rate of wicking and the amount of fluid wicked is optimized, for absorbent structures in consumer applications. It is desirable that such absorbent structures quickly wick away fluid discharge in order to facilitate transport of the discharged fluid throughout the absorbent structure and thereby minimize discomfort associated with wetness of the skin. It has been found that for absorbent structures made from stiffened, cellulosic fibers for consumer applications such as, but not limited to, diapers, catamenials, and tampons, substantially unswollen cellulosic fibers having large interfiber capillaries have provided better wicking and total absorbency than absorbent structures made from fibers having a highly swollen configuration. Stiffened fibers previously known in the art having unswollen fiber walls, however, have been made with such high levels of stiffening agent such that the fibers are extremely stiff, have been difficult to compress, and once compressed have had reduced ability to expand upon wetting. In addition to suffering fiber damage upon compression, such fibers are believed to have reduced ability to untwist, thereby limiting the creation or unleashing of expansionary fiber matrix forces previously discussed. On the other hand, fibers which have displayed high responsiveness to wetting have been stiffened while in a swollen condition, wherein the swelling decreases fiber stiffness but reduces wicking ability due to smaller interfiber capillaries. These fibers also have been made with relatively high levels of stiffening material. Additionally, such fibers have been made by nonaqueous solution crosslinking processes which are not economically viable.

In accordance with the present invention, fibers have been developed which exhibit the combination of high responsiveness to wetting along with high wicking ability. This has been done by stiffening the fibers while in a substantially unswollen condition, with low levels of chemical stiffening material relative to prior known stiffened fibers. Furthermore, prior to stiffening, the fibers are provided in an individualized, highly twisted configuration. Due to this substantially unswollen fiber condition, absorbent structures made from the fibers tend to exhibit high wicking ability. Due to the highly twisted and substantially unswollen condition of the fibers, lower amount of crosslinking agent are required to provide fibers which provide the desired levels of structural integrity and wet resilience in absorbent structures made from the fibers. Furthermore, the highly twisted fibers are highly susceptible to untwisting upon wetting as a result of low chemical stiffening treatment, which untwisting is believed to contribute to the absorbent structures' abilities to expand upon wetting. The fibers of the preferred embodiment of the present invention are curled, stiffened, individualized fibers having an average dry twist count of at 4.5 twist nodes per millimeter, an average wet fiber twist count of at least 3.0 twist nodes per millimeter wherein the wet fiber twist count is also at least 0.5 twist nodes per millimeter less than the dry fiber twist count, an average isopropyl alcohol retention value of less than about 30%, and an average water retention value of between about 28% and about 50%.

Preferably the fibers have an isopropyl alcohol retention level of less than about 27% and a water retention value of between about 30% and about 45%. Most preferably the water retention value is between about 35% and about 42%. Also preferably, the fibers have a dry twist count of at least about 5.5 twist nodes per millimeter and a wet twist count of at least about 4.0 twist nodes per millimeter. Most preferably, the fibers have a dry fiber twist count of at least about 6.5 twist nodes per millimeter and a wet fiber twist count of at least about 5.0 twist nodes per millimeter. Additionally, the fibers preferably have a curl factor of at least about 0.30, preferably at least about 0.50, wherein curl factor is calculated as a fractional shortening of the actual length of the fiber due to kinks, twists, and/or bends in the fiber.

Figure 2:
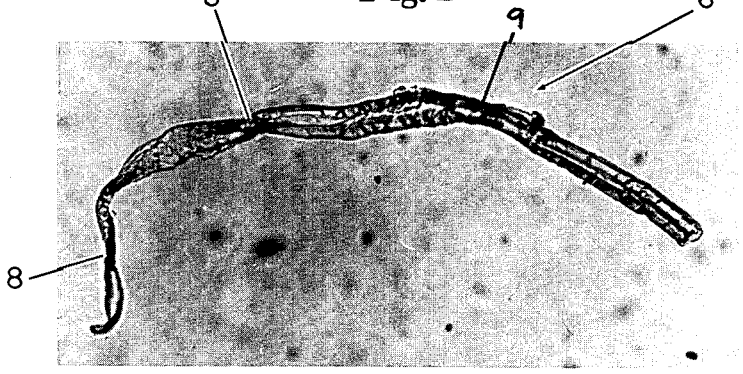
FIG. 2 is a photomicrograph of an individualized, twisted, stiffened, dry summerwood fiber fragment taken at a magnification level of 200X with transmitted light. The fiber was prepared in an immersion oil as in FIG. 1.

As used herein, the term "twist count" refers to the number of twist nodes present in a certain length of fiber. Twist count is utilized as a means of measuring the degree to which a fiber is rotated about its longitudinal axis. The term "twist node" refers to a substantially axial rotation of 180° about the longitudinal axis of the fiber, wherein a portion of the fiber (i.e., the "node") appears dark relative to the rest of the fiber when viewed under a microscope with transmitted light. The twist node appears dark at locations wherein the transmitted light passes through an additional fiber wall due to the aforementioned rotation. The distance between nodes corresponds to an axial rotation of 180°. The number of twist nodes in a certain length of fibers (i.e., the twist count) is directly indicative of the degree of fiber twist, which is a physical parameter of the fiber. The appearance and quantity of twist nodes will vary depending upon whether the fiber is a summerwood fiber or a springwood fiber. Shown in FIG. 1 is a photomicrograph of a dry springwood fiber 2. Shown in FIG. 2 is a photomicrograph of a dry summerwood fiber fragment 6 within the scope of the present invention. Springwood fiber 2 has exemplary twist nodes 4 specifically marked. Summerwood fiber 6 has exemplary twist nodes 8 specifically marked. The twist nodes and total twist count are determined by a Twist Count Image Analysis Method which is described in the Experimental Method section of the disclosure. Those skilled in the art will recognize that the photomicrographs in FIGS. 1 and 2 do not have the sharpness of detail that may be obtained utilizing the above mentioned Twist Count Image Analysis Method. Therefore, FIGS. 1 and 2 are presented only for the purpose of exemplifying fiber twists. The average twist count referred to in describing the fibers of the present invention is properly determined by the aforementioned twist count method. When counting twist nodes, portions of fiber darkened due to fiber damage or fiber compression should be distinguished from portions of fiber appearing darkened due to fiber twisting. For exemplary purposes, referring to FIG. 2, shown is a fiber compression 9 which is not considered a fiber twist node as described herein.

The actual twist count of any given sample of fibers will vary depending upon the ratio of springwood fibers to summerwood fibers. The twist count of any particular springwood or summerwood fibers will also vary from fiber to fiber. The average twist count limitations discussed above which are utilized to define the invention and these limitations apply regardless of the particular combination of springwood fibers and summerwood fibers. Any mass of fibers having twist count encompassed by the stated twist count limitations are meant to be encompassed within the scope of the present invention, so long as the other claimed limitations are met.

In the measurement of twist count for a sample of fibers, it is important that a sufficient amount of fibers be examined in order to accurately represent the average level of twist of the variable individual fiber twist levels. It is suggested that at least five (5) inches of cumulative fiber length of a representative sample of a mass of fibers be tested in order to provide a representative fiber twist count.

The wet fiber twist count is described and measured analogously to the dry fiber twist count, said method varying only in that the fiber is wetted with water prior to being treated and the twist nodes are then counted while wet in accordance with the Twist Count Image Analysis Method.

Preferably, the average dry fiber twist count is at least about 5.5 twist nodes per millimeter, and the average wet fiber twist count is at least about 4.0 twist nodes per millimeter and is at least 1.0 twist nodes per millimeter less than its dry fiber twist count. Most preferably, the average dry fiber twist count is at least about 6.5 twist nodes per millimeter, and the average wet fiber twist count is at least about 5.0 twist nodes per millimeter and is at least 1.0 twist nodes per millimeter less than the dry fiber twist count.

In addition to being twisted, the fibers of the present invention are curled. Fiber curl may be described as a fractional shortening of the fiber due to kinks, twists, and/or bends in the fiber. For the purposes of this disclosure, fiber curl shall be measured in terms of a two dimensional plane. The level of fiber curl shall be referred to in terms of a fiber curl factor. The fiber curl factor, a two dimensional measurement of curl, is determined by viewing the fiber in a two dimensional plane, measuring the projected length of the fiber as the longest dimension of a rectangle encompassing the fiber, $L_R$, and the actual length of the fiber $L_A$, and then calculating the fiber curl factor from the following equation:

$$\text{(1) Curl Factor} = (L_A/L_R) - 1 \quad (1)$$

Figure 3:
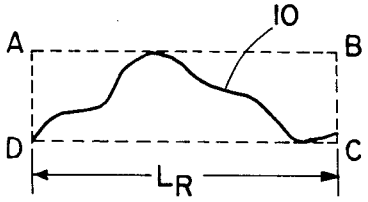
FIG. 3 is a drawing of a curled fiber having a maximum projected length of $L_R$.

A Fiber Curl Factor Image Analysis Method is utilized to measure $L_R$ and $L_A$. This method is described in the Experimental Methods section of this disclosure. The background information for this method is described in the 1979 International Paper Physics Conference Symposium, The Harrison Hotel, Harrison Hot Springs, British Columbia, Sept. 17–19, 1979 in a paper titled "Application Of Image Analysis To Pulp Fibre Characterization: Part 1," by B. D. Jordan and D. H. Page, pp. 104–114, Canadian Pulp and Paper Association (Montreal, Quebec, Canada), said reference being incorporated by reference into this disclosure. FIG. 3 shows a curled fiber 10 in a two dimensional plane. Fiber 10 is encompassed by rectangle A-B-C-D and has dimension $L_R$ corresponding to rectangular side A-B or C-D.

Preferably, the fibers have a curl factor of at least about 0.30, and more preferably have a curl factor of at least about 0.50.

The effect of stiffening fibers with chemical stiffening material is at least twofold. First, the preferred chemical stiffening materials stiffen the fiber walls, thereby reducing the ability of the fiber to swell upon wetting. Second, the chemical stiffening material tends to stiffen the fiber structure in such a way as to increase the fiber's resistance to deforming, e.g., bending. Alternately, this latter effect can be characterized as reduced fiber flexibility, and can be observed in the context of an absorbent structure as increased resistance to compression. As used herein, this latter effect of stiffness as it relates to resistance deformation shall be referred to as "fiber stiffness." Stiffness as it relates to resistance to fiber wall swelling shall be specifically referred to as "fiber wall stiffness." The level of chemical stiffening material applied to cellulosic fibers can be described in terms of the water retention value (WRV) of the fibers. When wetted with water, cellulosic fibers have an inherent tendency to absorb the water and swell. Chemical stiffening materials applied to the fibers inhibit the ability of the fiber to swell.

Fibers which do not swell at all in water lack the ability to untwist upon wetting and significantly, tend to be excessively stiff. For the present invention, a certain limited amount of swelling is desired since swelling induces untwisting of the fiber. Too much swelling is undesirable, however, because fibers which become highly swollen upon contact with water become too flexible to provide the desired levels of stiffness for absorbent structure integrity for responsiveness to wetting and wet resilience. The WRV range for the fibers of the present invention represents a balancing of untwisting ability with stiffness and wicking ability for fibers having ARV values previously described.

As previously stated, the WRV for the fibers of the present invention is between about 28% and about 50%. In preferred embodiments, the WRV of the fibers is between about 30% and about 45%. Most preferably, the WRV is between about 35% and about 42%. Fibers having WRV within the latter range are especially preferred since they are believed to provide an optimal balance of swelling-induced untwisting and fiber stiffness.

The degree of swelling at which cellulose fibers are chemically stiffened can be described in terms of the volume of fluid which the fibers will retain upon removal of substantially all interfiber fluid, which fluid is of a type which will not cause cellulose fibers to swell. For the purpose of this disclosure, the fluid utilized for this purpose is isopropyl alcohol (IPA), and the volume of fluid retained shall be referred to as the isopropyl alcohol retention value (ARV). The ARV as used herein can be calculated according to the Isopropyl Alcohol Retention Value Method described in the Experimental Methods section below. The limitation that the fibers of the present invention have an ARV of less than about 30% is indicative of the dehydrated, unswollen state of the fiber during the stiffening process. As previously stated, the ARV is preferably less than about 30%. Most preferably, the ARV is less than about 27%.

Cellulosic fibers of diverse natural origin are applicable to the invention including fibers from hardwood and softwood cellulosic fiber sources. Fibers from softwood are preferably utilized. Those skilled in the art will recognize that northern softwoods will have higher springwood/summerwood ratios than southern softwoods, and in view of the preceding discussion on fiber twist, will also recognize that samples of northern softwood fibers may consequently have higher average fiber twist counts. The present invention is meant to encompass individualized, stiffened, twisted fibers regardless of springwood/summerwood fiber ratio, so long as such twist count and other applicable limitations are met. The fibers may be supplied in slurry, unsheeted or sheeted form. Fibers supplied as wet lap, dry lap or other sheeted form are preferably rendered into unsheeted form by mechanically disintegrating the sheet, preferably prior to contacting the fibers with the crosslinking agent. Also, preferably the fibers are provided in a wet or moistened condition. Most preferably, the fibers are never-dried fibers. In the case of dry lap, it is advantageous to moisten the fibers prior to mechanical disintegration in order to minimize damage to the fibers.

The optimum fiber source utilized in conjunction with this invention will depend upon the particular end use contemplated. Generally, pulp fibers made by chemical pulping processes are preferred. Completely bleached, partially bleached and unbleached fibers are applicable. It may frequently be desired to utilize bleached pulp for its superior brightness and consumer appeal. In one novel embodiment of the invention, hereinafter more fully described, the fibers are partially bleached, crosslinked, and then bleached to completion. For products such as paper towels and absorbent pads for diapers, sanitary napkins, catamenials, and other similar absorbent paper products, it is especially preferred to utilize fibers from southern softwood pulp due to the premium absorbency characteristics of such pulp.

The cellulosic fibers are stiffened and dried while in substantially individual form with fiber-to-fiber contact being minimized during drying. In general, the fibers are contacted with a stiffening material and subjected to one or more additional steps in which the fibers are dried and the stiffening material is activated. Those skilled in the art will understand that natural cellulosic fibers having a microfibrillar ultrastructure have a tendency to twist as they are dried of water or other fiber-swelling fluid. The degree to which a fiber will twist is dependent on a variety of factors, one of the most significant of which is the level of fiber-to-fiber contact of the drying fibers. It is desirable to minimize fiber-to-fiber contact during drying in order to minimize interfiber hydrogen bonding of the wet or moist fibers which inhibits twisting of such fibers.

Chemical stiffening materials applicable to this invention include a variety of monomeric crosslinking agents including, but not limited to, $C_2$–$C_8$ dialdehydes and $C_2$–$C_8$ monoaldehydes having an acid functionality. Other stiffening materials which may have application to this invention include, but are not limited to, polymers such as urea formaldehyde resins and modified starches.

Preferred crosslinking agents applicable to the present development include the $C_2$–$C_8$ dialdehydes, as well as $C_2$–$C_8$ monoaldehydes also having an acid functionality. These compounds are capable of reacting with at least two hydroxyl groups in a single cellulose chain or on proximately located cellulose chains in a single fiber. It should be recognized that such compounds may be present in solution in a variety of oligomeric forms, and chemical analogues to such compounds may be present which crosslink in the manner of the referenced compounds. It is intended that such oligomers and chemical analogues be included within the $C_2$–$C_8$ dialdehydes and $C_2$–$C_8$ monoaldehydes having an acid functionality, as used above. Preferred crosslinking agents contemplated for use with the invention are glutaraldehyde, glyoxal, and glyoxylic acid. Glutaraldehyde is especially preferred, since it has provided fibers with the high levels of absorbency and resiliency, is believed to be safe and non-irritating to human skin when crosslinked with cellulose, and has provided the most stable, crosslink bonds. Monoaldehydic compounds not having an additional carboxylic group, such as formaldehyde, acetaldehyde and furfural, are also applicable to this invention but are less preferred for several reasons including safety concerns.

The preferred crosslinking agents are reacted to form crosslink bonds between hydroxyl groups of a single cellulose chain or between hydroxyl groups of proximately located cellulose chains of a single cellulosic fiber. These crosslink bonds are believed to provide the requisite stiffness needed for absorbent structure expansion. Although not presented or intended to limit the scope of the invention, it is believed that the crosslinking agent reacts with the hydroxyl groups of the cellulose to form hemiacetal and acetal bonds. The formation of acetal bonds, believed to be the desirable bond types providing stable crosslink bonds, is favored under acidic reaction conditions. Therefore, acid catalyzed crosslinking conditions are highly preferred for curing the preferred crosslinking agents.

In general, any substance which catalyzes the crosslinking mechanism may be utilized. Applicable catalysts include organic acids and acid salts. Especially preferred catalysts are salts such as aluminum, magnesium, zinc and calcium salts of chlorides, nitrates or sulfates. One specific example of a preferred salt is zinc nitrate hexahydrate. Other applicable catalysts include organic acids and mineral acids such as sulfuric acid and hydrochloric acid. The selected catalyst may be utilized as the sole catalyzing agent, or in combination with one or more other catalysts. It is believed that combinations of acid salts and organic acids as catalyzing agents provide superior crosslinking reaction efficiency. Unexpectedly high levels of reaction completion have been observed for catalyst combinations of zinc nitrate salts and organic acids, such as citric acid, and the use of such combinations is preferred. Mineral acids are useful for adjusting pH of the fibers while being contacted with the crosslinking agent in solution, but are preferably not utilized as the primary catalyst.

A catalytically-effective amount of catalyst should be used. The amount of catalyst preferably utilized is, of course, dependent upon the particular type and amount of crosslinking agent and the reaction conditions, especially temperature and pH. In general, based upon technical and economic considerations, catalyst levels of between about 10 wt. % and about 60 wt. %, based on the weight of crosslinking agent added to the cellulosic fibers, are preferred. For exemplary purposes, in the case wherein the catalyst utilized is zinc nitrate hexahydrate and the crosslinking agent is glutaraldehyde, a catalyst level of about 30 wt. %, based upon the amount of glutaraldehyde added, is preferred. Most preferably, between about 5% and about 30%, based upon the weight of the glutaraldehyde, of an organic acid, such as citric acid, is also added as a catalyst. It is additionally desirable to adjust the aqueous portion of the cellulosic fiber slurry or crosslinking agent solution to a target pH of between about pH 2 and about pH 5, more preferably between about pH 2.5 and about pH 3.5, during the period of contact between the crosslinking agent and the fibers.

After being contacted with the solution containing crosslinking agent, the cellulosic fibers are dewatered and preferably partially dried. In the preferred embodiment, the cellulosic fibers are dewatered and partially dried to a fiber consistency of between about 30% and about 80%. More preferably, the fibers are dewatered and dried to a consistency level of between about 40% and about 60%. Drying the fibers to within these preferred ranges generally will facilitate defibration of the fibers into individualized form without excessive formation of knots associated with higher moisture levels and without high levels of fiber damage associated with lower moisture levels.

For exemplary purposes, dewatering may be accomplished by such methods as mechanically pressing, centrifuging, or air drying the pulp. Additional drying is preferably performed by such methods, known in the art as air drying or flash drying, under conditions such that the utilization of high temperature for an extended period of time is not required. Excessively high temperature at this stage of the process may result in the premature initiation of crosslinking. Preferably, temperatures in excess of about 160° C. are not maintained for periods of time in excess of 2 to 3 seconds.

Subsequent to dewatering and, optionally, partial drying, the fibers are separated into substantially individualized form. This may be accomplished by mechanically defibrating into a low density, individualized, fibrous form known as "fluff" prior to reaction of the crosslinking agent with the fibers. Mechanical defibration may be performed by a variety of methods which are presently known in the art or which may hereinafter become known. Mechanical defibration is preferably performed by a method wherein knot formation and fiber damage are minimized. One type of device which has been found to be particularly useful for defibrating the cellulosic fibers is the three stage fluffing device described in U.S. Pat. No. 3,987,968, issued to D. R. Moore and O. A. Shields on Oct. 26, 1976, said patent being hereby expressly incorporated by reference into this disclosure. The fluffing device described in U.S. Pat. No. 3,987,968 subjects moist cellulosic pulp fibers to a combination of mechanical impact, mechanical agitation, air agitation and a limited amount of air drying to create a substantially knot-free fluff.

Other applicable methods for defibrating the cellulosic fibers include, but are not limited to, treatment with a Waring blender and tangentially contacting the fibers with a rotating disk refiner or wire brush. Preferably, an air stream is directed toward the fibers during such defibration to aid in separating the fibers into substantially individual form.

Mechanical refining of fibers at high consistency or of partially dried fibers may also be utilized to provide curl or twist to the fibers in addition to curl or twist imparted as a result of mechanical defibration.

The fibers are preferably mechanically treated while initially containing at least about 20% moisture to minimize fiber damage, and preferably while containing between about 40% and about 60% moisture.

Maintaining the fibers in substantially individual form during drying and crosslinking allows the fibers to twist during drying and thereby be crosslinked in such twisted, curled state. Drying fibers under such conditions that the fibers may twist and curl is referred to herein as drying the fibers under substantially unrestrained conditions since contact with other fibers inhibits the relative occurrence of twisting and curling of the fiber.

The defibrated fibers are heated to a suitable temperature for an effective period of time to cause the crosslinking agent to react with the cellulosic fibers. The rate and degree o crosslinking depends upon dryness of the fibers, temperature, amount and type of catalyst and crosslinking agent and the method utilized for heating and/or drying the fibers while crosslinking is performed. Crosslinking at a particular temperature will occur at a higher rate for fibers of a certain initial moisture content when accompanied by a continuous air through drying than when subjected to drying/heating in a static oven. Those skilled in the art will recognize that a number of temperature-time relationships exist for the reaction of the crosslinking agent with the fibers. Conventional paper drying temperatures, (e.g., 120° C. to about 150° C.), for periods of between about 30 minutes and 60 minutes, under static, atmospheric conditions will generally provide acceptable reaction efficiencies for fibers having moisture contents less than about 5%. Those skilled in the art will also appreciate that higher temperatures and air convection decrease the time required for the crosslinking reaction. However, reaction temperatures are preferably maintained at less than about 160° C., since exposure of the fibers to such high temperatures in excess of about 160° C. may lead to yellowing or other damaging of the fibers.

Following the crosslinking step, the fibers are preferably washed. A sufficient amount of a basic substance such as caustic may be added in the washing step to neutralize any acid remaining in the pulp. After washing, the fibers are defluidized and dried. The fibers while still in a moist condition may be subjected to a second mechanical defibration step which causes the crosslinked fibers to twist and curl between the defluidizing and drying steps. The same apparatuses and methods previously described for defibrating the fibers are applicable to this second mechanical defibration step. As used in this paragraph, the term "defibration" refers to any of the procedures which may be used to mechanically separate the fibers into substantially individual form, even though the fibers may already be provided in such form. "Defibration" therefore refers to the step of mechanically treating the fibers, in either individual form or in a more compacted form, wherein such mechanical treatment step a) separates the fibers into substantially individual form if they were not already in such form, and b) imparts curl and twist to the fibers upon drying.

This second defibration treatment, after the fibers have been crosslinked, is believed to increase the twisted, curled character of the pulp. This increase in the twisted, curled configuration of the fibers leads to enhanced absorbent structure resiliency and responsiveness to wetting.

For product applications wherein the crosslinked fibers are disposed next to or in the vicinity of a person's skin, it is desirable to further process the fibers to remove excess, unreacted crosslinking agent. Preferably, the level of unreacted crosslinking agent is reduced to at least below about 0.03%, based on the dry weight of the cellulosic fibers. One series of treatments found to successfully remove excess crosslinking agent comprise, in sequence, washing the crosslinked fibers, allowing the fibers to soak in an aqueous solution for an appreciable time, screening the fibers, dewatering the fibers, e.g., by centrifuging, to a consistency of between about 40% and about 80%, mechanically defibrating the dewatered fibers as previously described and air drying the fibers. This process has been found to reduce residual free crosslinking agent content to between about 0.01% and about 0.15%.

In another method for reducing residual crosslinking agent, readily extractable crosslinking agent is removed by alkaline washes. Alkalinity may be introduced by basic compounds such as sodium hydroxide, or alternatively in the form of oxidizing agents such as those chemicals commonly utilized as bleaching agents, e.g., sodium hypochlorite, and amino-containing compounds, e.g., ammonium hydroxide, which hydrolyze hemiacetal bonds to form Schiff bases. The pH is preferably maintained at a level of at least about pH 7, and more preferably at least about pH 9, to inhibit reversion of the acetal crosslink bond. It is preferred to induce decomposition of hemiacetal bonds, while being neutral towards acetal bonds. Therefore, those extracting agents which operate at alkaline conditions are preferred. Single wash treatments with 0.01N and 0.1N ammonium hydroxide concentrations were observed to reduce residuals content to between about 0.0008% and about 0.0023% for soaking periods of 30 minutes to two (2) hours. Minimal additional benefit is believed to incur for soaking times in excess of about 30 minutes and for ammonium hydroxide concentrations in excess of about 0.01N.

Both single stage oxidation and multiple stage oxidation were found to be effective methods of extracting residual crosslinking agent. Single stage washing with 0.1% available chlorine (av.Cl) to about 0.8% av.Cl, based upon the dry weight of the fibers, supplied in the form of sodium hypochlorite was observed to reduce residual crosslinking agent levels to between about 0.0015% and about 0.0025%.

In one novel approach to producing crosslinked, individualized fibers, the source fibers are subjected to a conventional multistage bleaching sequence, but at a midpoint during the sequence the bleaching process is interrupted and, the fibers are crosslinked in accordance with the present invention. Subsequent to curing, the remainder of the bleaching sequence is completed. It has been found that acceptably low crosslinking agent residual levels of less than about 0.006% can be obtained in this manner. This method is believed to embody the preferred manner of producing crosslinked fibers, since the capital expense and processing inconvenience of additional washing and extraction equipment and additional process steps are avoided due to merger of the bleaching and residual reduction steps. The bleaching sequences practiced and the point of interruption in the sequences for crosslinking may vary widely, as will be evident to one of ordinary skill in the art, However, multi-stage bleaching sequences, wherein DEP* or DEH* stages follow crosslinking, have been found to provide desirable results. (*D - chlorine dioxide, E - caustic extraction, P - peroxide, H - sodium hypochlorite). The post-crosslinking bleaching sequence stages are preferably alkaline treatments performed at pH greater than about pH 7, and more preferably greater than about pH 9.

The individualized stiffened fibers of the present invention may be utilized directly in the manufacture of air laid absorbent cores. Additionally, due to their stiffened and resilient character, the crosslinked fibers may be wet laid into an uncompacted, low density sheet which, when subsequently dried, is useful without further mechanical processing as an absorbent core. The crosslinked fibers may also be wet laid as compacted pulp sheets for sale or transport to distant locations.

Once the individualized, stiffened fibers are made, they may be dry laid and directly formed into absorbent structures, or wet laid and formed into absorbent structures or densified pulp sheets. The fibers of the present invention provide a variety of substantial performance advantages. However, it is difficult to form such fibers into a smooth, wet laid sheet by conventional wet sheet formation practices. This is because individualized, twisted, stiffened fibers rapidly flocculate when in solution. Such flocculation may occur both in the headbox and upon deposition into the foraminous forming wire. Attempts to sheet individualized, crosslinked fibers by conventional pulp sheeting methods may result in the formation of a plurality of clumps of flocculated fibers. This is believed to be related to the stiffened, twisted character of the fibers and the high drainability of the fibers once deposited on a sheet forming wire.

Accordingly, a novel process for sheeting individualized, twisted, stiffened fibers which tend to flocculate in solution has been developed, wherein a slurry containing individualized, stiffened fibers are initially deposited on a foraminous forming wire, such as a Fourdrinier wire in a manner similar to conventional pulp sheeting processes. Due to the nature of fibers, they are deposited on the forming wire in a plurality of clumps of fibers. At least one stream of fluid, preferably water, is directed at the deposited, clumped fibers. Preferably, a series of showers are directed at the fibers deposited on the forming wire, wherein successive showers have decreasing volumetric flow rates. The showers should be of sufficient velocity such that the impact of the fluid against the fibers acts to inhibit the formation of flocculations of the fibers and to disperse flocculations of fibers which have already formed. The fiber setting step is preferably performed with a cylindrical screen, such as a dandy roll, or with another apparatus analogous in function which is or may become known in the art. Once set, the fibrous sheet may then be dried and optionally compacted as desired. The spacing of the showers will vary depending upon the particular rate of fiber flocculation, line speed of the forming wire, drainage through the forming wire, number of showers, and velocity and flow rate through the showers. Preferably, the showers are close enough together so that substantial levels of flocculation are not incurred.

In addition to inhibiting the formation of and dispersing flocculations of fibers, the fluid showered onto the fibers also compensates for the extremely fast drainage of individualized, crosslinked fibers, by providing additional liquid medium in which the fibers may be dispersed for subsequent sheet formation. The plurality of showers of decreasing volumetric flow rates facilitates a systematic net increase in slurry consistency while providing a repetitive dispersive and inhibiting effect upon flocculations of the fibers. This results in the formation of a relatively smooth and even deposition of fibers which are then promptly, i.e., before reflocculation, set into sheeted form by allowing the fluid to drain and pressing the fibers against the foraminous wire.

Relative to pulp sheets made from conventional, cellulosic fibers, the pulp sheets made from the individualized, stiffened, twisted fibers of the present invention are more difficult to compress to conventional pulp sheet densities. Therefore, it may be desirable to combine such stiffened fibers with conventional fibers. Pulp sheets containing the fibers of the present invention may contain between about 5% and about 90% conventional cellulosic fibers, based upon the total dry weight of the sheet. It is especially preferred to include between about 5% and about 30% of highly refined, conventional cellulosic fibers, based upon the total dry weight of the sheet. Such highly refined fibers are refined or beaten to a freeness level less than about 300 ml CSF, and preferably less than 100 ml CSF. The conventional fibers may then be mixed with the individualized, stiffened, twisted fibers in an aqueous slurry. This slurry may then be formed into a densified pulp sheet for subsequent defibration and formation into absorbent pads. The incorporation of the conventional fibers eases dry compression of the pulp sheet into a densified form, while imparting a surprisingly small loss in absorbency to the subsequently formed absorbent pads. The conventional fibers increase the tensile strength of the pulp sheet. Regardless of whether the blend of individualized, stiffened, twisted fibers and conventional fibers are first made into a pulp sheet and then formed into an absorbent pad or formed directly into an absorbent pad, the absorbent pad may be air-laid or wet-laid as previously described.

The individualized, stiffened, twisted fibers herein described are useful for a variety of absorbent articles including, but not limited to, tissue sheets, disposable diapers, catamenials, sanitary napkins, tampons, and bandages wherein each of said articles has an absorbent structure containing the present fibers. For example, a disposable diaper or similar article having a liquid permeable topsheet, a liquid impermeable backsheet connected to the topsheet, and an absorbent structure containing the present fibers is particularly contemplated. Such diapers are described generally in U.S. Pat. No. 3,860,003, issued to Kenneth B. Buell on Jan. 14, 1975, hereby incorporated by reference into this disclosure.

A surprising and unexpected benefit of the fibers of the present invention in absorbent structure applications is that increased resistance to delamination is obtained upon folding of such structures while in a wet condition. This benefit is of particular significance for absorbent structure performance in applications such as diapers and catamenials, wherein the absorbent structure is in an at least partially folded configuration while wet, or is subjected to such configuration subsequent to wetting. In such situations, folding of an absorbent structure made from conventional fibers causes it to delaminate. Dry absorbent structures made from individualized fibers can be characterized as having a continuously integrated fiber matrix, wherein a relatively low variance of fiber density exists throughout the matrix. However, wetted absorbent structures in general tend to delaminate, or form into one or more stratified layers of fibers separated by substantially parallel fiber-free regions, upon folding or other structural deformation. The occurrence of delamination adversely affects the wicking ability of the absorbent structure due to the absence of capillary routes for absence of capillary routes for wicking in fiber-free regions. In essence, fluid which is absorbed by a delaminated absorbent structure is wicked to a point at which the direction of wicking is perpendicular to the fiber-free region. The fiber-free regions act as barriers to wicking, thereby reducing effectiveness of the absorbent structure. The absorbent structures of the present invention have unexpectedly displayed enhanced resistance to such delamination compared to absorbent structures made from prior known conventional fibers or from prior known, less twisted, individualized, stiffened fibers.

Sheets or webs made from the individualized, stiffened, twisted fibers, or from mixtures also containing conventional fibers, will preferably have basis weights of less than about 800 g/m$^2$ and densities of less than about 0.60 g/cm$^2$. Although it is not intended to limit the scope of the invention, wet-laid sheets having basis weights between 300 g/m$^2$ and about 600 g/m$^2$ and densities between 0.015 g/cm$^3$ and about 0.30 g/cm$^3$ are especially contemplated for direct application as absorbent cores in disposable articles such as diapers, tampons, and other catamenial products. Structures having basis weights and densities higher than these levels are believed to be most useful for subsequent comminution and air-laying or wet-laying to form a lower density and basis weight structure which is more useful for absorbent applications. However, such higher basis weight and density structures also exhibit surprisingly high absorptivity and responsiveness to wetting and the preferred embodiment description above is not meant to limit the scope or application of the invention. Other applications contemplated for the fibers of the present invention include low density tissue sheets having densities which may be less than 0.10 g/cm$^3$.

In one application, individualized, stiffened, twisted fibers are formed into either an air laid or wet laid (and subsequently dried) absorbent core which is compressed to a dry density less than the equilibrium wet density of the pad. The density, or saturation density, is the density of the pad, calculated on a dry fiber basis when the pad is fully saturated with fluid. When fibers are formed into an absorbent core having a dry density greater than the equilibrium wet density, upon wetting to saturation, the core will expand to the equilibrium wet density. Pads made from the fibers of the present invention have equilibrium wet densities which are substantially lower than pads made from conventional fluffed fibers. The fibers of the present invention can be compressed to a density higher than the equilibrium wet density, to form a thin pad which, upon wetting, will expand, thereby increasing absorbent capacity, to a degree significantly greater than obtained for conventional fibers.

The levels of crosslinking agent utilized to provide the desired levels of water retention value for the fibers of the present invention preferably range between about 0.75 mole % and about 2.0 mole % of the preferred crosslinking agents reacted with the fibers, calculated on a cellulose anhydroglucose molar basis. More preferably, between about 1.0% and about 2.0%, and most preferably between about 1.2% and about 1.6% of the preferred crosslinking agents reacted with the fibers, calculated on a cellulose anhydroglucose molar basis, is utilized.

EXPERIMENTAL PROCEDURES

Transport Absorbency Method

The following method was used to measure the transport index of absorbent structures made from the fibers tested in the Examples.

A 14 inch by 14 inch laid absorbent structure is provided, slightly compressed, cut into nine approximate 4.5 inch by. 4.5 inch squares, pressed to a target density, trimmed to four inches by four inches, and weighed. An absorbent structure square is placed between a bottom flat plate having a central orifice and a top plate. The top plate, once set in place, is immovable with respect to the bottom plate, thereby keeping dry fiber density at the target density regardless of absorption.

A buret is provided, filled with water or isopropyl alcohol depending upon which fluid transport index is to be measured. A tube extends from the buret to the orifice of the bottom plates, such that fluid in the tube contacts the bottom surface of the absorbent structure. The fluid is furnished to the structure at about zero hydrostatic head. Once wicking is initiated, a timer is started. The volume of liquid absorbed is read from the buret for periodic time intervals. The slope of absorbed fluid volume versus the square root of time is calculated by regression analysis. This slope is referred to as the transport index.

Twist Count Image Analysis Method

The following method was used to determine the twist count of fibers analyzed in this disclosure.

Dry fibers were placed on a slide coated with a thin film of immersion oil, and then covered with a cover slip. The effect of the immersion oil was to render the fiber transparent without inducing swelling and thereby aid in identification of the twist nodes (described below). Wet fibers were placed on a slide by pouring a low consistency slurry of the fibers on the slide which was then covered with a cover slip. The water rendered the fibers transparent so that twist node identification was facilitated.

An image analyzer comprising a computer-controlled microscope, a video camera, a video screen, and a computer loaded with QUIPS software, available from Cambridge Instruments Limited (Cambridge, England; Buffalo, N.Y.), was used to determine twist count.

The total length of fibers within a particular area of the microscope slide at 200X magnification was measured by the image analyzer. The twist nodes were identified and marked by an operator. This procedure was continued, measuring fiber length and marking twist nodes until five inches of total fiber length were analyzed. The number of twist nodes per millimeter was calculated from this data by dividing the total fiber length into the total number of twist nodes marked.

Curl Factor Image Analysis Method

The following method was utilized to measure fiber curl factor.

Dry fibers were placed onto a microscope slide. A cover slip was placed over the fibers and glued in place at the edges. The actual length $L_A$ and the maximum projected length $L_R$ (equivalent to the length of the longest side of a rectangle encompassing the fiber) are measured utilizing an image analyzer comprising a software controlled microscope, video camera, video monitor, and computer. The software utilized was the same as that described in the Twist Count Image Analysis Method section above. FIG. 3 shows a curled fiber 10 encompassed by rectangle A-B-C-D having a maximum projected length $L_R$.

Once $L_A$ and $L_R$ are obtained, the curl factor for each individual fiber is calculated according to Equation (1) shown earlier. The curl factor for each sample of fiber is calculated for at least 250 individual fibers and then averaged to determine the average curl factor for the sample. Fibers having $L_A$ less than 0.25 mm are excluded from the calculation.

Procedure For Determining Water Retention Value

The following procedure was utilized to determine the water retention value (WRV) of cellulosic fibers.

A sample of about 0.3 g to about 0.4 g of fibers is soaked in a covered container with about 100 ml distilled or deionized water at room temperature for between about 15 and about 20 hours. The soaked fibers are collected on a filter and transferred to an 80-mesh wire basket supported about 1.5 inches above a 60-mesh screened bottom of a centrifuge tube. The tube is covered with a plastic cover and the sample is centrifuged at a relative centrifuge force of 1500 to 1700 gravities for 19 to 21 minutes. The centrifuged fibers are then removed from the basket and weighed. The weighed fibers are dried to a constant weight at 105° C. and reweighed. The water retention value is calculated as follows:

$$WRV = \frac{(W - D)}{D} \times 100 \quad (1)$$

where,

W = wet weight of the centrifuged fibers;
D = dry weight of the fibers; and
W-D = weight of absorbed water.

Procedure For Determining Isopropyl Alcohol Retention Value

The following procedure was utilized to determine the isopropyl alcohol retention value (ARV) of cellulosic fibers.

A sample of about 0.3 g to about 0.4 g of fibers is soaked in a covered container with about 100 ml isopropyl alcohol (IPA) at room temperature for between about 15 and about 20 hours. The soaked fibers are collected on a filter and transferred to an 80-mesh wire basket supported about 1.5 inches above a 60-mesh screened bottom of a centrifuge tube. The tube is covered with a plastic cover and the sample is centrifuged at a relative centrifuge force of 1500 to 1700 gravities for 19 to 21 minutes. The centrifuged fibers are then removed from the basket and weighed. The weighed fibers are dried to a constant weight at 105° C. and reweighed. The isopropyl alcohol retention value is calculated as follows:

$$ARV = \frac{(W - D)}{D} \times 100 \quad (1)$$

where,

W=wet weight of the centrifuged fibers;
D=dry weight of the fibers; and
W-D=weight of absorbed isopropyl alcohol.

Procedure For Determining Drip Capacity

The following procedure was utilized to determine drip capacity of absorbent cores. Drip capacity was utilized as a combined measure of absorbent capacity and absorbency rate of the cores.

A four inch by four inch absorbent pad weighing about 7.5 g is placed on a screen mesh. Synthetic urine is applied to the center of the pad at a rate of 8 ml/s. The flow of synthetic urine is is halted when the first drop of synthetic urine escapes from the bottom or sides of the pad. The drip capacity is calculated by the difference in mass of the pad prior to and subsequent to introduction of the synthetic urine divided by the mass of the fibers, bone dry basis.

Procedure For Determining Wet Compressibility

The following procedure was utilized to determine wet compressibility of absorbent structures. Wet compressibility was utilized as a measure of resistance to wet compression, wet structural integrity and wet resilience of the absorbent cores.

A four inch by four inch square pad weighing 7.5 g is prepared, its thickness measured and density calculated. The pad is loaded with synthetic urine to ten times its dry weight or to its saturation point, whichever is less. A 0.1 PSI compressional load is applied to the pad. After a 60 second equilibration period, the thickness of the pad is measured. The compressional load is then increased to 1.1 PSI, and the thickness is measured after a 60 second equilibration period. The compressional load is then reduced to 0.1 PSI, and the thickness is again measured after a 60 second equilibration period. The densities are calculated for the pad at the original 0.1 PSI load, the 1.1 PSI load and the second 0.1 PSI load, referred to as 0.1 PSIR (PSI rebound) load. The void volume reported in cc/g, is then determined for each respective pressure load. The void volume is the reciprocal of the wet pad density minus the fiber volume (0.95 cc/g). The 0.1 PSI and 1.1 PSI void volumes are useful indicators of resistance to wet compression and wet structural integrity. Higher void volumes for a common initial pad densities indicate greater resistance to wet compression and greater wet structural integrity. The difference between 0.1 PSI and 0.1 PSIR void volumes is useful for comparing wet resilience of absorbent pads. A smaller difference between 0.1 PSI void volume and 0.1 PSIR void volume, indicates higher wet resilience.

Also, the difference in caliper between the dry pad and the saturated pad prior to compression was found to be a useful indicator of the responsiveness to wetting of the pads.

Procedure For Determining Level Of Glutaraldehyde Reacted With Cellulosic Fibers The following procedure was utilized to determine the level of glutaraldehyde which reacted to form intrafiber crosslink bonds with the cellulosic component of the individualized, glutaraldehyde-crosslinked fibers.

A sample of individualized, crosslinked fibers is extracted with 1.0N HCl for one (1) hour at 60° C. The extract is separated from the fibers and mixed with an aqueous solution of 2,4-dinitrophenylhydrazone (DNPH). The reaction is allowed to proceed for 15 minutes after which a volume of chloroform is added to the mixture. The reaction mixture is mixed for an additional 45 minutes. The chloroform and aqueous layers are separated with a separatory funnel. The level of glutaraldehyde is determined by analyzing the chloroform layer by high pressure liquid chromatography (HPLC) for DNPH derivative.

The chromatographic conditions for HPLC analysis utilized were Column: C-18 reversed phase; Detector: UV at 360 nm; Mobile phase 80:20 methanol: water; Flow rate: 1 ml/min.; measurement made: peak height. A calibration curve of peak height and glutaraldehyde content was developed by measuring the HPLC peak heights of five standard solutions having known levels of glutaraldehyde between 0 ppm and 25 ppm.

The chloroform phase for each fiber sample was analyzed by HPLC, the peak height measured, and the corresponding level of glutaraldehyde determined from the calibration curve. The glutaraldehyde concentration was divided by the fiber sample weight (dry fiber basis) to provide glutaraldehyde content on a fiber weight basis.

Two glutaraldehyde peaks were present for each of the HPLC chromatograms. Either peak may be used, so long as that same peak is used throughout the procedure.

Procedure For Determining Level Of Formaldehyde Reacted With Cellulosic Fibers The same procedure used to determine glutaraldehyde reacted with cellulose was used to determine formaldehyde reacted with cellulose, except a calibration curve was developed specifically for formaldehyde rather than glutaraldehyde and the fiber samples were extracted with 12N H for two (2) hours at 90° C. rather than with 1.0N HCl for one (1) hour at 60° C. Only one HPLC peak was observed for the formaldehyde-containing chloroform phase.

EXAMPLE I

Individualized, stiffened fibers of the present invention were made by a dry crosslinking process utilizing glutaraldehyde as the crosslinking agent.

For each sample, a quantity of never dried, southern softwood kraft (SSK) pulp was provided. The fibers had a moisture content of about 62.4% (equivalent to 37.6% consistency). A slurry was formed by adding the fibers to a solution containing a selected amount of 50% aqueous solution of glutaraldehyde, 30% (based upon the weight of the glutaraldehyde) zinc nitrate hexahydrate, demineralized water and a sufficient amount of 1N HCl to decrease the slurry pH to about 3.7. The fibers were soaked in the slurry for a period of 20 minutes and then dewatered to a fiber consistency of about 34% to about 35% by centrifuging. Next, the dewatered fibers were air dried to a fiber consistency of about 55% to about 56% with a blow through dryer utilizing ambient temperature air. The air dried fibers were defibrated utilizing a three-stage fluffing device as described in U.S. Pat. No. 3,987,968. The defibrated fibers were placed in trays and cured at 145° C. in an essentially static drying oven for a period of 45 minutes. Crosslinking was completed during the period in the oven. The crosslinked, individualized fibers were placed on a mesh screen and washed with about 20° C. water, soaked at 1% consistency for one (1) hour in 60° C. water, screened, washed with about 20° C. water for a second time, centrifuged to 60% fiber consistency, defibrated in a three stage fluffer as previously described, and dried to completion in a static drying oven at 105° C. for four (4) hours. Glutaraldehyde reacted was calculated on a dry fiber cellulose anhydroglucose basis to be 1.41 mole %. The results are discussed in Example VIII.

EXAMPLE II

The method described in U.S. Pat. No. 4,035,147 in Example 2, Test 6 was substantially followed. A 4% pulp slurry of never-dried SSK fibers was prepared and then dehydrated by washing with acetone. The acetone washing treatment was conducted for four consecutive passes with filtering after each wash. The dehydrated fibers were air dried to about 50% consistency and then dried unrestrained in an air-lay pad maker before soaking the fibers for five minutes in a 0° C. solution containing 91.8 wt. % acetone, 0.9 wt. % hydrogen chloride, 0.8 wt. % formaldehyde, and 6.5 wt. % water, during which time crosslinking of the formaldehyde with the fibers occurred. The fibers were washed to neutrality with water, air dried and then formed into absorbent structures at desired densities. The fibers had 3.5 mole % formaldehyde reacted therewith, calculated on a cellulose, anhydroglucose molar base. The results are discussed in Example VIII.

EXAMPLE III

The method described in U.S. Pat. No. 3,756,913, Example I was substantially followed. A 1% consistency pulp slurry of never dried SSK fibers was prepared. The pH was adjusted to pH 4 by addition of sulfuric acid. Based upon the dry weight of the fibers, 15% of urea formaldehyde resin (Casco Resin PR-335, Bordon Chemical Division of Bordon, Inc., Columbus, Ohio) was added while the slurry was mildly agitated. The pH of the slurry was continually adjusted to maintain a 4.0–4.5 pH level for 4.7 minutes. The fibers were then steeped for an additional two minutes, drained, centrifuged to 37% fiber consistency, mechanically fluffed with a three-stage fluffing device as described in U.S. Pat. No. 3,987,968, and oven dried for two hours at 122° C. The dried, cured product was made into absorbent structures at desired densities. The fibers had 4.5 mole % urea formaldehyde resin reacted therewith, calculated on a urea molar percentage basis of cellulose anhydroglucose molecular units. The results are discussed in Example VIII.

EXAMPLE IV

The method of U.S. Pat. No. 3,241,553, Example I was substantially followed. A solution containing 34.0 wt. % formaldehyde, 7.9 wt. % sulfuric acid, and 58.1 wt. % water was prepared and heated to 80° C. SSK fibers in pulp sheet form were immersed in the solution for ten minutes, drained, and thoroughly rinsed, first with hot water (45°–50° C.) and then with cold water. The pH of water squeezed from the washed fibers was 7.1. The washed fibers were disintegrated with agitation at 2 wt. % fiber consistency in cold water and then air dried. The fibers had 10.5 mole % formaldehyde reacted therewith, calculated on a cellulose anhydroglucose molar basis. The results are discussed in Example VIII.

EXAMPLE V

The same process as described in Example I was followed, except that the level of glutaraldehyde crosslinking agent was sufficiently increased to provide 4.4 mole % glutaraldehyde reacted with the fiber. The results are discussed in Example VIII.

EXAMPLE VI

The same process as described in Example I was followed, except that the level of glutaraldehyde reacted with the fibers was 1.36 mole %, and the fibers were dried to 81 wt. % fiber consistency prior to fluffing. The purpose of the increased drying prior to fluffing was to produce a lower twist level fiber. The results are discussed in Example VIII.

EXAMPLE VII

The same process as described in Example I was followed, except that the level of glutaraldehyde reacted with the fibers was 1.25 mole %, and the fibers were dried to 91 wt. % fiber consistency prior to fluffing. The resulting fibers had a fiber twist level lower than that of Example VI. The results are discussed in Example VIII.

EXAMPLE VIII

The fibers and absorbent structures of Examples I through VI were tested and analyzed. The wet and dry twist counts, dry curl index, water retention value, and isopropyl alcohol retention values were measured for the fibers of each example, in accordance with the methods described in the Experimental Methods section of this disclosure. The results are recorded below in Table I.

TABLE I

| Example # | Dry Twist (nodes/mm) | Wet Twist (nodes/mm) | Dry Curl Factor | ARV (%) | WRV (%) |
|---|---|---|---|---|---|
| I | 6.8 | 5.1 | .63 | 24 | 37 |
| II | 4.4 | 3.9 | .59 | 33 | 44 |
| III | 3.4 | 2.0 | .60 | 19 | 62 |
| IV | 1.6 | 0.7 | .35 | 47 | 68 |
| V | 4.1 | 3.7 | .35 | 27 | 32 |
| VI | 4.7 | 3.0 | .60 | 27 | 38 |
| VII | 2.7 | 1.8 | .42 | 24 | 39 |

The fibers of Examples I through IV were made into four inch by four inch rectangular air-laid absorbent pads at dry fiber densities of 0.01g/cc, 0.20 g/cc and 0.30 g/cc. Drip capacity was measured for 0.20 g/cc pads and wet compressibility was measured for 0.10 g/cc and 0.20 g/cc pads. Transport index was measured for 0.10g/cc, 0.20 g/cc, and 0.30 g/cc pads. The results are reported below in Tables II and III.

TABLE II

| Example # | Drip Capacity (g/g) | Density (g/cc) | Wet Compressibility (cc/g) 0.1 PSI | 1.1 PSI | 0.1 PSIR |
|---|---|---|---|---|---|
| I | N/A | 0.10 | 12.2 | 7.7 | 8.6 |
| II | N/A | 0.10 | 12.4 | 7.5 | 8.6 |
| III | N/A | 0.10 | 9.5 | 6.1 | 6.6 |
| IV | N/A | 0.10 | 10.0 | 5.8 | 6.6 |
| V | N/A | 0.10 | 10.2 | 7.0 | 7.7 |
| VI | N/A | 0.10 | 11.6 | 7.3 | 8.1 |
| VII | N/A | 0.10 | 11.0 | 7.3 | 7.9 |
| I | 14.0 | 0.20 | 10.2 | 6.7 | 7.3 |
| II | 15.7 | 0.20 | 10.7 | 6.9 | 7.8 |
| III | 4.9 | 0.20 | 8.5 | 5.4 | 5.8 |
| IV | 12.3 | 0.20 | 10.0 | 5.5 | 6.2 |
| V | 3.9 | 0.20 | 7.1 | 4.3 | 5.0 |
| VI | 13.3 | 0.20 | 10.0 | 6.4 | 7.0 |
| VII | 11.7 | 0.20 | 9.8 | 6.2 | 6.8 |

TABLE III

| Example # | Density (g/cc) | Transport Index ($ml/sec^{\frac{1}{2}}$) Water | IPA |
|---|---|---|---|
| I | 0.10 | 9.2 | 3.9 |
| | 0.20 | 5.4 | 2.2 |
| | 0.30 | 3.0 | N/A |
| II | 0.10 | 8.8 | 3.7 |
| | 0.20 | 4.6 | 2.3 |
| | 0.30 | 2.3 | N/A |
| III | 0.10 | N/A | N/A |
| | 0.20 | 4.7 | N/A |
| | 0.30 | N/A | N/A |
| IV | 0.10 | 7.8 | 3.8 |
| | 0.20 | 4.2 | 2.2 |
| | 0.30 | N/A | N/A |
| V | 0.10 | 10.1 | N/A |
| | 0.20 | 5.8 | N/A |
| | 0.03 | N/A | N/A |
| SSK fluff, (untreated) | 0.10 | 5.9 | 3.6 |
| | 0.20 | 4.0 | 2.1 |
| | 0.30 | 1.7 | N/A |

Table I shows that only the fibers of Examples I, III, V, VI and VII had ARV's of less than 30. The ARV's of these examples are lower than the others as a result of being chemically stiffened while in a highly dehydrated, nonswollen condition. The fibers of example II, while being chemically stiffened in a hydrated condition, were not collapsed to the same degree as the fibers of Example I, III, V and VI due in large part to reduced swelling resulting from acetone dehydration relative to air-drying.

Figure 4:
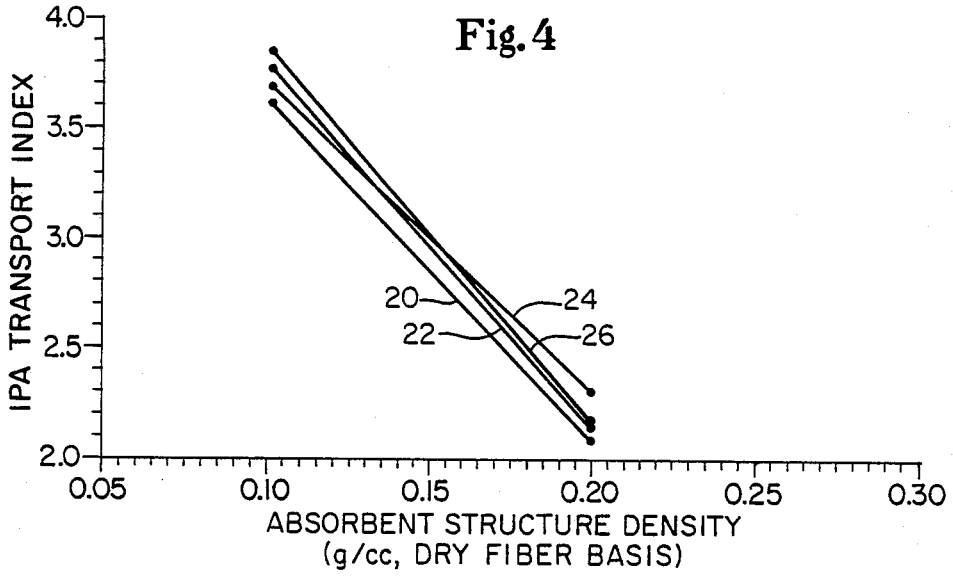
FIG. 4 is a graph of isopropyl alcohol transport index versus absorbent structure density.
Figure 5:
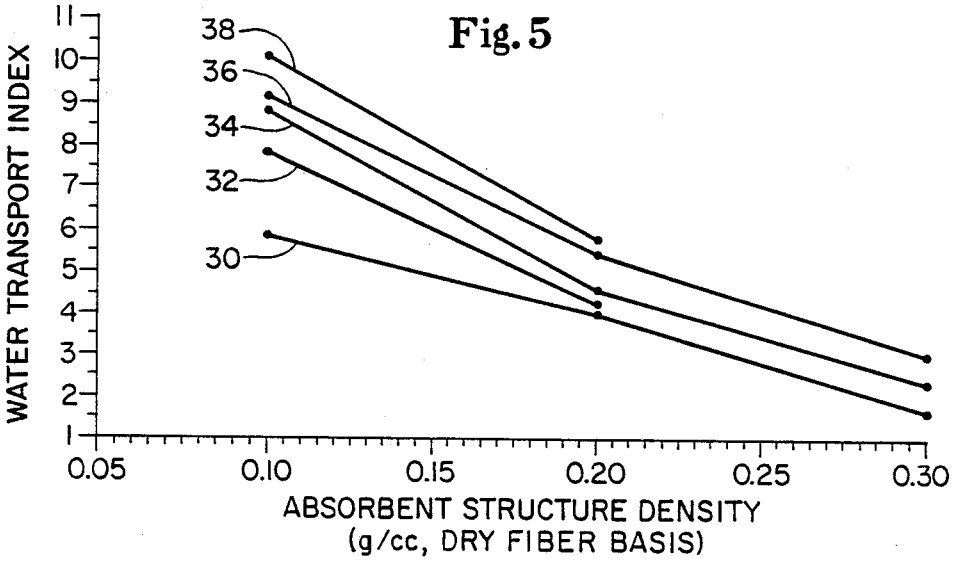
FIG. 5 is a graph of water transport index versus absorbent structure density.

The data set forth in Table III are graphically shown in plotted form in FIGS. 4 and 5. FIG. 4 is a plot of transport index for isopropyl alcohol (IPA) versus dry density of the absorbent pad. FIG. 5 is a plot of transport index for water versus dry. density of the absorbent pad. In FIGS. 4 and 5, lines 20 and 30 correspond to untreated SSK fluff, lines 22 and 32 correspond to Example IV, lines 24 and 34 correspond to Example II, lines 26 and 36 correspond to Example I, and line 38 corresponds to Example V. Examples VI and VII fibers were not measured for transport index. A comparison between transport index for IPA, which does not swell cellulosic fibers, and water, which does swell cellulosic fibers, indicates that wicking ability of the absorbent pad is substantially the same for each of the pads when isopropyl alcohol is the wicked fluid, but substantially larger differences in wicking between the pads are observed when water is the wicked fluid. Significantly, the pads made from fibers having both low ARV values and low WRV values, Example I and V fibers had the highest transport index values. Referring now to Table II, it can be seen that pads made from the fibers of Example I had substantially better responsiveness to wetting, and rebound upon compression and compression release of the wet pad than pads made from the fibers of Example V. Also significantly, the ARV values (Table I) of the fibers of Examples I and VI are less than the ARV values of the fibers of Example II. This difference, as described above, is due to crosslinking the fibers of Examples I and VI in an air-dried, substantially dehydrated, unswollen condition whereas the fibers of Example II are crosslinked in an acetone-extracted, dehydrated state which is at a relatively higher degree of swelling than the air-dried fibers.

Upon consideration of the data and discussion presented above, it should be understood that the novel fibers of the present invention can be utilized to make absorbent structures having similar bench test absorbency and resiliency performance to the solution cured individualized, stiffened fibers, such as those presented in Example II, while at the same time having a substantially different structural parameters. The structural differences between such fibers can be characterized in at least two distinct manners: first, in terms of level of twist; and second, in terms of the level of swelling of the stiffened fiber in the dry state, as exemplified by ARV value. In addition, it should be recognized that the novel fibers of the present invention can be made by dry crosslinking processes which are substantially more economically viable than the nonaqueous solution curing process utilized to make the fibers of Example II.

EXAMPLE IX

Pads are made from the fibers of Examples I, II, IV, VI, and VII. The pads are made at 0.20 g/cc density in four inch by four inch rectangles. The pads are wetted to ten times their weight with synthetic urine, compressed at 1.1 PSI pressure for about 60 seconds, and the pressure is released such that the pads are allowed to expand unrestrained and a sufficient amount of synthetic urine is added to the pad to adjust the total weight of the wet pad to ten times the dry fiber weight. The pads are then folded in half, compressed at 0.2 PSI for 60 seconds, unfolded, and examined for signs of delamination. As used herein, delamination refers to the formation in the absorbent pad of layers of fiber visually observable with a naked eye. The pads are repeatedly subjected to this folding compressing procedure. After only two folds, the pads made from the fibers of Examples IV and VII incurred high levels of delamination. Pads made from the fibers of Example II incurred a lesser, though still observable, level of delamination after two folds. Pads made from the fibers of Example VI displayed delamination after five folds. However, pads made from the fibers of Example I did not incur such visually observable delamination even after five folds. Thus, in addition to the benefit of the fibers of the present invention discussed in Example VIII, pads made from the present invention have an unexpected additional advantage of increased resistance to delamination. It is believed that this superior resistance to delamination is related to the high level of twist of the fibers of Example I.

While the foregoing discussion discloses certain embodiments and examples of individualized, stiffened, twisted fibers and absorbent structures made therefrom, the scope of the present invention is to be defined by the claims which follow.

What is claimed is:

1. Cellosic fibrous material comprising individualized, chemically stiffened, curled cellulosic fibers and a crosslinking agent, wherein said crosslinking agent is selected from the group consisting of $C_2$–$C_8$ dialdehydes, $C_2$–$C_8$ dialdehyde acid analoques having at least one aldehyde group, and oligomers of said dialdehydes and dialdehyde acid analogues, said fibers chemically stiffened by reaction with from about 0.75 mole % to about 2.0 mole % of said crosslinking agent, calculated on a cellulose anhydroglucose molar basis, said fibers having:

a. an average dry fiber twist count of at least about 4.5 twist nodes per millimeter;

b. an average wet fiber twist count of at least about 3.0 twist nodes per millimeter and at least about 0.5 twist nodes per millimeter less than said dry fiber twist count;

c. an average isopropyl alcohol retention value of less than about 30%; and d. an average water retention value of between about 28% and about 50%.

2. Cellulosic fibrous material as in claim 1, wherein said fibers have an average dry fiber curl factor of at least about 0.30.

3. Cellulosic fibrous material as in claim 2, wherein said average dry fiber curl factor is at least about 0.50.

4. Cellulosic fibrous material as in claim 1, wherein said average dry fiber twist count is at least about 5.5 twist nodes per millimeter and said average wet fiber twist count is at least about 4 twist nodes per millimeter and at least about 1.0 twist node per millimeter less than said average dry fiber twist count.

5. Cellulosic fibrous material as in claim 4, wherein said average dry fiber twist count is at least about 6.5 twist nodes per millimeter and said average wet fiber twist count is at least about 5.0 twist nodes per millimeter.

6. Cellulosic fibrous material as in claim 1, wherein said average isopropyl alcohol retention value is less than about 27%.

7. Cellulosic fibrous material as in claim 6, wherein said average water retention value is between about 30% and about 45%.

8. Cellulosic fibrous material as in claim 7, wherein said fibers have an average water retention value of between about 35% and about 42%.

9. Cellulosic fibrous material as in claim 8, wherein said average dry fiber curl factor is at least about 0.50, said average dry twist count is at least about 6.5 twist nodes per millimeter, and said average wet twist count is at least about 5.0 twist nodes per millimeter and is at least about 1.0 twist node per millimeter less than said average wet twist count.

10. The cellulosic fibrous material of claim 9, wherein said crosslinking agent is selected from the group consisting of glutaraldehyde, glyoxal, and glyoxylic acid, said fibers being individually stiffened therewith.

11. Cellulosic fibrous material as in claim 10, wherein said crosslinking agent is glutaraldehyde.

12. An absorbent structure comprising a mass of individualized, chemically stiffened, curled cellulosic fibers and a crosslinking agent, wherein said crosslinking agent is selected from the group consisting of $C_2$–$C_8$ dialdehydes, $C_2$–$C_8$ dialdehyde acid analogues having at least one aldehyde group, and oligmers of said dialdehydes and dialdehyde acid analogues, said fibers chemically stiffened by reaction with from about 0.75 mole % to about 2.0 mole % of said crosslinking agent, calculated on a cellulose anhydroglucose molar basis, said fibers having:

a. an average dry fiber twist count of at least about 4.5 twist nodes per millimeter;

b. an average wet fiber count of at least about 3.0 twist nodes per millimeter and at least about 0.5 twist nodes per millimeter less than said dry fiber twist count;

c. an average isopropyl alcohol retention value of less than about 30%; and d. an averge water retention value of between about 28% and about 50%.

13. An absorbent structure as in claim 12, wherein said fibers have an average dry fiber curl factor of at least about 0.30.

14. An absorbent structure as in claim 13, wherein said average dry fiber curl factor is at least about 0.50.

15. An absorbent structure as in claim 12, wherein said average dry fiber twist count is at least about 5.5 twist nodes per millimeter and said average wet fiber twist count is at least about 4.0 twist nodes per millimeter and at least about 1.0 twist node per millimeter less than said average dry fiber twist count.

16. An absorbent structure as in claim 15, wherein said average dry fiber twist count is at least about 6.5 twist nodes per millimeter and wet fiber twist count is at least about 5.0 twist nodes per millimeter.

17. An absorbent structure as in claim 12, wherein said average isopropyl alcohol retention value is less than about 27%.

18. An absorbent structure as in claim 17, wherein said average water retention value is between about 30% and about 45%.

19. An absorbent structure as in claim 18, wherein said fibers have an average water retention value of between about 35% and about 42%.

20. An absorbent structure as in claim 19, wherein said average dry fiber curl factor is at least about 0.50, said average dry twist count is at least about 5.5 twist nodes per millimeter, and said average wet twist count is at least about 4.0 twist nodes per millimeter and is at least about 1.0 twist node per millimeter less than said average wet twist count.

21. An absorbent structure as in claim 20, wherein said average dry fiber twist count is at least 6.5 twist nodes per millimeter and said average wet fiber twist count is at least 5.0 twist nodes per millimeter.

22. The absorbent structure of claim 21 wherein said crosslinking agent is selected from the group consisting of glutaraldehyde, glyoxal, and glyoxylic acid, said fibers being individually stiffened therewith.

23. An absorbent structure as in claim 22, wherein said crosslinking agent is glutaraldehyde.

24. An absorbent structure as in claim 11, wherein said structure has a dry density and an equilibrium wet density, both calculated on a dry fiber weight basis, said dry density being greater than said equilibrium wet density.

25. An absorbent structure as in claim 21, wherein said structure has a dry density and an equilibrium wet density, both calculated on a dry. fiber weight basis, said dry density being greater than said equilibrium wet density.

26. An absorbent structure as in claim 23, wherein said structure has a dry density and an equilibrium wet density, both calculated on a dry. fiber weight basis, said dry density being greater than said equilibrium wet density.

27. The absorbent structure of claim 12, 20, 21, 23, 24, 25, or 26 further comprising polymeric gel forming material admixed through at least a portion of said absorbent structure.

28. The absorbent structure of claim 12, 20, 21, 23, 24, 25, or 26 further comprising polymeric gel forming material adjacent to a surface of said absorbent structure.

* * * * *

UNITED STATES PATENT AND TRADEMARK OFFICE

CERTIFICATE OF CORRECTION

PATENT NO. : 4,898,642

DATED : February 6, 1990

INVENTOR(S) : Danny R. Moore, James W. Owens and Howard L. Schoggen

It is certified that error appears in the above-identified patent and that said Letters Patent is hereby corrected as shown below:

Column 2, line 27, reads "ellulosic" should read --cellulosic--.

Column 6, line 31, after "at" insert --least--.

Column 12, line 39, reads "o" should read --of--.

Column 14, line 20, delete "," (comma) and insert therefor --.-- (period).

Column 16, line 41, reads "$g/cm^2$" should read --$g/cm^3$--.

Column 20, line 50, after "H" insert --$_2SO_4$--.

Column 21, line 31, reads "$0^oC$" should read --$50^oC$--.

Column 22, line 61, reads "IV" should read --VII--.

Column 23, line 42, reads "hydrated" should read --dehydrated--.

Column 25, line 53, delete "wet" and insert therefor --dry--.

Column 25, line 65, reads "oligmers" should read --oligomers--.

Column 26, line 43, delete "wet" and insert therefor --dry--.

Column 26, line 61, delete "." (period)

Column 26, line 66, delete "." (period)

Signed and Sealed this

Third Day of March, 1992

*Attest:*

HARRY F. MANBECK, JR.

*Attesting Officer*

*Commissioner of Patents and Trademarks*